United States Patent [19]

Anderson

[11] 4,249,510

[45] Feb. 10, 1981

[54] HEARTH VENTILATORS FOR DOMESTIC FIREPLACES

[75] Inventor: Billy B. Anderson, Burlington, Iowa

[73] Assignee: Vega Industries, Inc., Des Moines, Iowa

[21] Appl. No.: 51,525

[22] Filed: Jun. 25, 1979

[51] Int. Cl.[3] ..... F24B 3/00

[52] U.S. Cl. ..... 126/121; 126/123

[58] Field of Search ..... 126/120, 121, 123, 126, 126/129, 131

[56] References Cited

U.S. PATENT DOCUMENTS

| | | | |
|---|---|---|---|
| 2,245,074 | 6/1941 | Mathis | 126/120 |
| 2,409,731 | 10/1966 | Balinger | 126/120 |
| 2,707,464 | 5/1955 | Gillan | 126/121 |
| 2,821,975 | 2/1958 | Thulman | 126/120 |
| 3,180,332 | 4/1965 | Grushkin | 126/121 |
| 4,153,036 | 5/1979 | Billmeyer | 126/121 |
| 4,186,719 | 2/1980 | Dalsin | 126/120 |

*Primary Examiner*—Herbert F. Ross

*Attorney, Agent, or Firm*—Zarley, McKee, Thomte, Voorhees & Sease

[57] ABSTRACT

A system for providing a supply of air for supporting combustion in a fireplace from a source outside the room wherein the fireplace is installed. The outside air passes through ducts extending along each side of the fireplace and communicating with opposite ends of a manifold extending entirely across the front of the fireplace and having an open top immediately adjacent the lower, front edge of the fireplace so that air from the manifold is drawn directly into the firebox. The air may also provide cooling for the walls of the fireplace.

10 Claims, 6 Drawing Figures

HEARTH VENTILATORS FOR DOMESTIC FIREPLACES

FIELD OF THE INVENTION

The present invention relates to improvements in domestic fireplaces and, more specifically, to novel means by which outside air is provided both for purposes of cooling and for supporting combustion.

BACKGROUND OF THE INVENTION

Since the time that central heating systems became the most common method of heating domestic living quarters, fireplaces have been used primarily for esthetic effects. With the recent shortages and emphasis on conservation of fossil fuels, the fireplace has again come into prominence as a space heating appliance.

In order to optimize heating efficiency, it is desirable that oxygen supporting combustion should be provided by air drawn from outside the room or space to be heated. In many prior devices, when air from the room is drawn into the firebox by the natural draft of combustion products passing up the flue, cold outside air must be drawn into the room through whatever path is available. Consequently, air is often drawn into the house through doors, windows, and other openings, thereby defeating the heating function of the fireplace.

In relatively recent years, the so-called "factory built" fireplaces have come into prominent usage. Such fireplaces are constructed chiefly of sheet metal and are shipped in a condition ready for installation in a dwelling, as opposed to the traditional masonry fireplace which is essentially an integral part of the sturcture in which it is built. The factory built fireplaces generally require that passages be provided for flow of air under the hearth and about other areas of the fireplace structure subject to direct heat in order to avoid the possibility of overheating and igniting flammable portions of the building in which the fireplace is installed. For the reasons previously mentioned, it is desirable that air from outside the room or space to be heated be utilized for purposes of providing a moving layer of cooling air between elements of the fireplace and adjacent portions of the structure in which it is installed.

It is a principal object of the present invention to provide novel and improved apparatus for supplying air to a fireplace structure within a room from a source outside the room, while at the same time preventing exposure of the room to the cooler temperature of the outside air.

Another object of the invention is to provide means for supplying air both for supporting combustion and for preventing an overheating condition in a factory-built fireplace from a source outside the room in which the fireplace is installed.

A further object is to provide air supply means, drawn from an outside source, for supplying combustion supporting air to an open fireplace in a relatively evenly distributed air curtain across the front of the firebox.

A further object of the present invention is the provision of baffle means which separates outside air into two areas so as to facilitate partial cooling in the vicinity of the baffle.

A further object of the present invention is the utilization of a baffle means which provides protection against hot particles falling into the base of the air vent tubes.

A further object of the invention is the provision of a device which can be installed after the fireplace is in position and with a minimum of structural changes.

A further object of the present invention is the provision of a device which has means for easy access to the air inlet damper for repair and maintenance.

A further object of the present invention is a device which includes a grill cover designed to withstand the impact of a wood log which may be dropped when the fireplace is being fueled.

A further object of the present invention is the provision of a device which permits outside air to enter the fireplace through openings beneath the glass door frame whenever a glass door frame is used with the fireplace.

Other objects will in part be apparent and will in part appear hereinafter.

BRIEF SUMMARY OF THE INVENTION

In accordance with the foregoing objects, the invention contemplates a pair of air ducts, each communicating at one end with a source of air from outside the room or space which communicates directly with the fireplace firebox through an open front thereof. The two ducts communicate at their opposite ends with an air distribution manifold closed on the sides and bottom, having an open top extending across and immediately forward of the front, lower edge of the hearth.

Separately controlled dampers are provided for selectively opening or closing each of the ducts, which preferably extend from their connections with the manifold along opposite sides of the fireplace for communication with the outside air. Also, baffle arrangements within the manifold and its supporting structure effectively preclude dangerous overheating conditions.

DETAILED DESCRIPTION OF THE INVENTION

Figure 1:
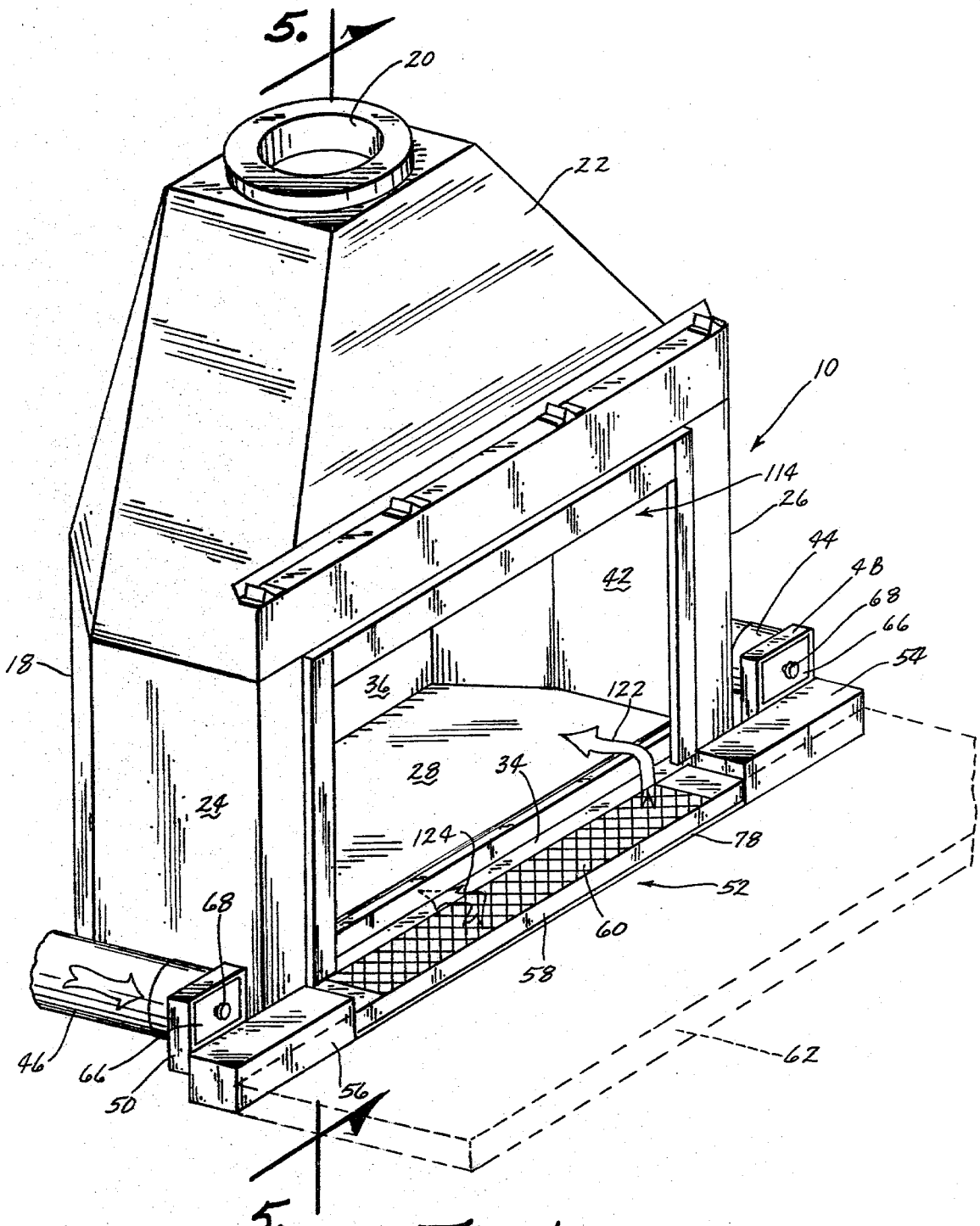
FIG. 1 is a perspective view of a typical factory built fireplace with the outside air apparatus of the present invention incorporated therewith.
Figure 5:
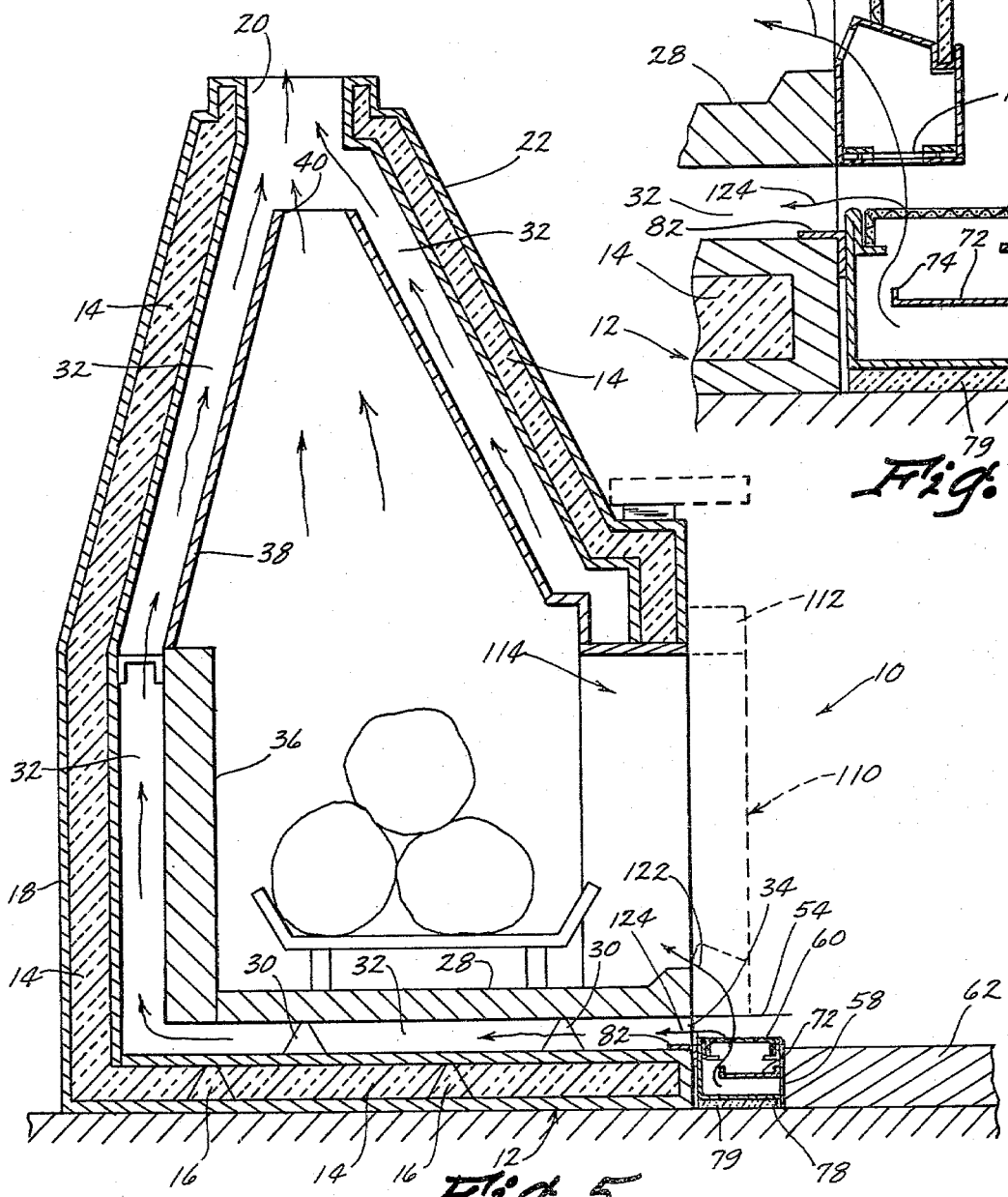
FIG. 5 is a sectional view taken along line 5—5 of FIG. 1.

Referring now to the drawings, in FIGS. 1 and 5, are seen a typical fireplace of the factory built type designated generally by the reference numeral 10. Fireplace 10 includes a bottom wall 12 of double thickness having a fire resistant insulative material 14 within the double thickness thereof. The double thickness of wall 12 is held in separate spaced apart relation by a plurality of supports 16. Fireplace 10 also includes a double thickness rear wall 18 having insulative material 14 located therein. Rear wall 18 angles forwardly adjacent its upper end and terminates adjacent an opening 20 adapted to be connected to a chimney flue. Fireplace 10 also includes a forward wall 22 provided with insulative material 14 in a fashion similar to bottom and rear walls 12, 18. Fireplace 10 is also provided with side walls 24, 26 which are similar in construction to bottom, rear and front walls 12, 18 and 22.

A hearth floor 28 is mounted in spaced relation above bottom wall 12 by means of supports 30 so that an air space 32 is provided between hearth floor 28 and bottom wall 12. Air space 32 is exposed to the interior of the room being heated by a front opening 34. A rear fire wall 36 extends upwardly from hearth floor 28 in spaced relation to rear wall 14 so that air space 32 continues upwardly between rear fire wall 36 and rear wall 18. At the upper end of fire wall 36 is a plate 38 which angles upwardly in spaced relation to rear wall 18, and which terminates at an upper end 40. Extending up from the lateral sides of hearth floor 28 are a pair of interior side walls 42 which are spaced inwardly from side walls 24, 26 similar to the manner in which plate 38 is spaced inwardly from rear wall 18. Thus, air space 32 extends around the bottom, rear, and sides of the firebox defined by hearth floor 28, fire wall 36, plate 38, and side walls 42. Adjacent the upper end of rear wall 18, air space 32 is in communication with opening 20 so that a draft is provided from front opening 34 around the fire box and upwardly through opening 20. This draft permits cool air to be drawn in through opening 34 to provide a cooling of the walls of the fire box.

Combustion within the firebox is normally supported by air drawn in through the open front thereof, although the prior art includes systems wherein outside air (i.e., air taken from a source outside the space communicating with the open fireplace front) is supplied through one or more ducts directly or indirectly to the firebox, usually through the sides, rear or bottom of the fireplace. In such cases, the open front of the firebox may be closed by movable glass doors, or the like, in order to block entry of room air when combustion is supported through the outside air ducts.

According to the present invention, outside air is provided through a pair of cylindrical ducts 44 and 46 which extend along each side of fireplace 10, near floor level, from any suitable source of communication with outside air. The ducts may, of course, extend in any direction most convenient for communication with the outside air source in the particular installation. At their forward ends, ducts 44 and 46 communicate with the rear sides of box-like structures 48 and 50, respectively. As seen in FIG. 1, the latter include portions extending downwardly from the ducts and communicate, through the forward sides of the lower portions, with opposite ends of a manifold denoted generally by reference numeral 52.

Manifold 52 extends completely across the lower, front side of fireplace 10, being divided generally into end portions 54 and 56, and central portion 58. End portions 54 and 56 are fully enclosed except for an opening in one side of each communicating with the lower interior of box-like structures 48 and 50, and in one end communicating with the ends of central portion 58. At least the section of central portion 58 which lies adjacent the lower edge of the frontal opening of the firebox is open on the top side, such opening being covered by open grillwork 60. The upper surface of hearth extension 62, commonly provided in conjunction with factory-built fireplaces, is preferably flush with the upper surface of the grillwork. The arrows in FIG. 1 indicate generally the flow of outside air from manifold 52 into fireplace 10.

Figure 2:
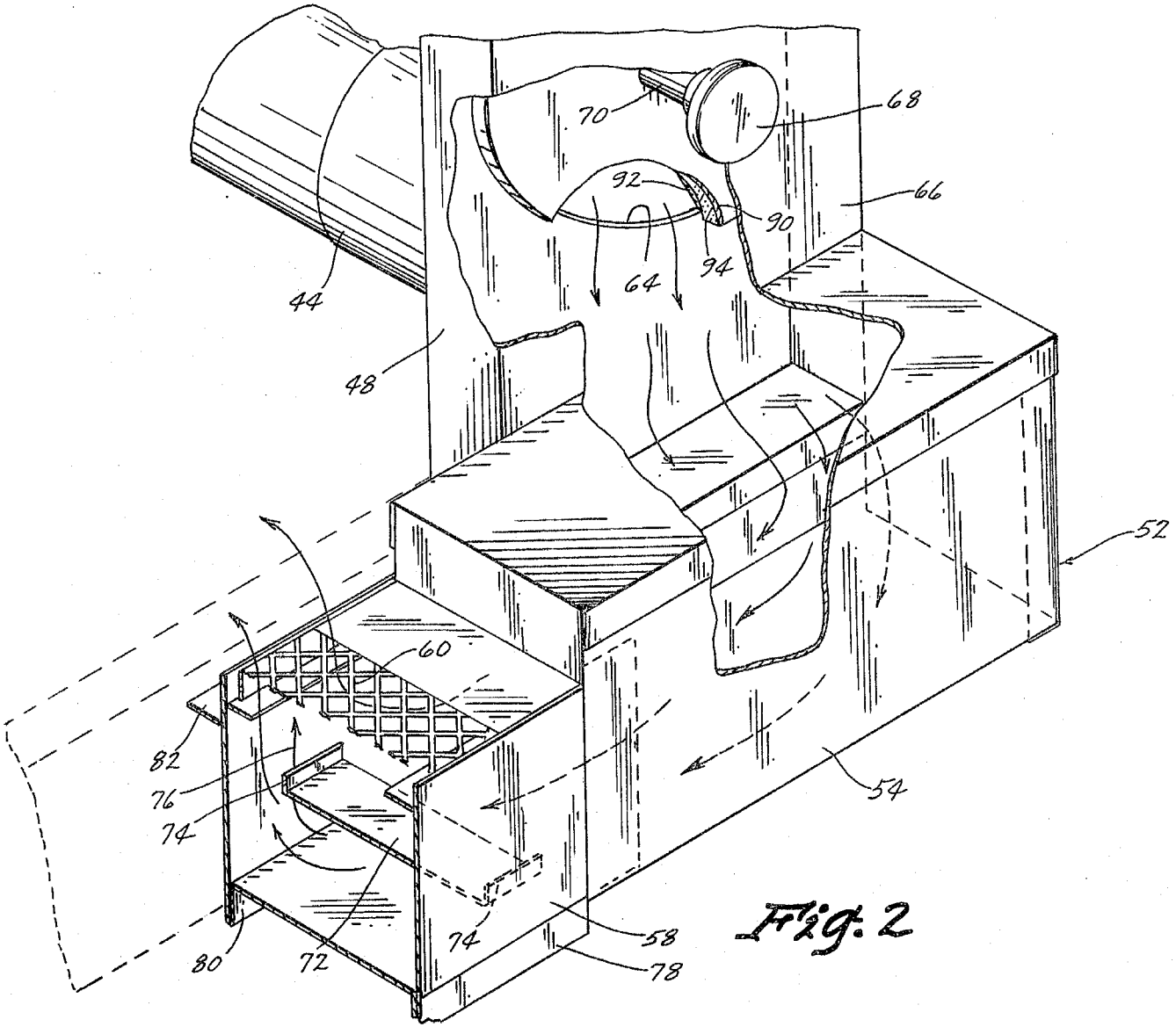
FIG. 2 is an enlarged, fragmentary, perspective view of portions of the structure of FIG. 1.
Figure 4:
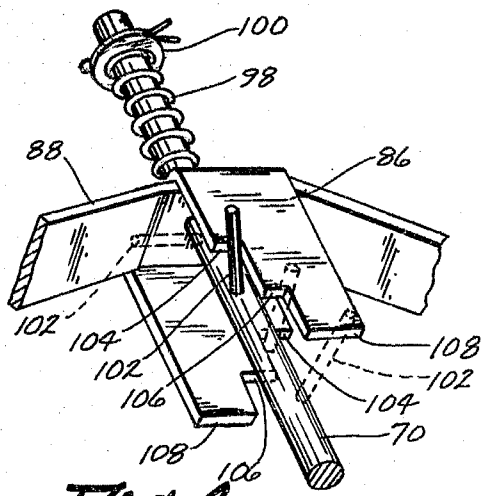
FIG. 4 is a fragmentary, perspective view of the damper locking mechanism of FIG. 3.
Figure 3:
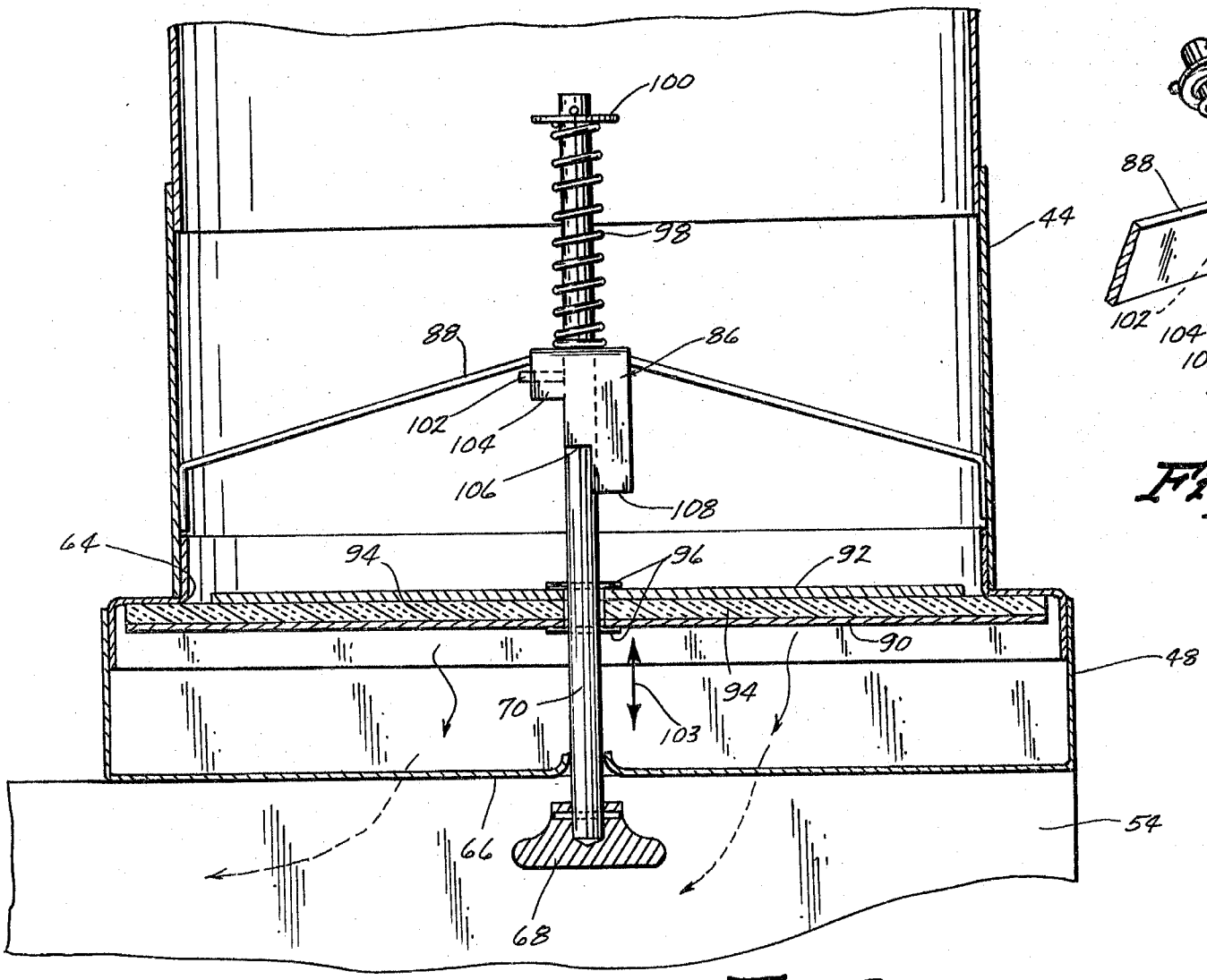
FIG. 3 is a fragmentary, plan view in horizontal section, of a portion of the structure of FIG. 2.

Turning now to FIG. 2, the internal structure of the apparatus of the invention is shown in more detail. In particular, an opening 64 may be seen through the broken-away portion of front plate 66 of box-like structure 48. A damper construction, described more fully in connection with FIGS. 3 and 4, is mounted for movement between covering and uncovering positions with respect to opening 64 by manipulation of handle 68 on shaft 70 which extends through front plate 66. The latter is preferably removable to facilitate repair or servicing of the damper or other internal portions of the structure.

In FIG. 2 is also clearly shown the path of outside air from duct 44, through opening 64 into structure 48 and thence into end portion 54 of manifold 52. As the air enters central portion 58, it is preferably divided by a baffle 72 into upper and lower layers. Baffle 72 extends horizontally substantially from end to end of central portion 58. Baffle 72 has one of its longitudinal flanged edges 74 attached to the forward wall of central portion 58. The opposite longitudinal flanged edge 74 is spaced inwardly from the rear wall of central portion 58 whereby the lower layer of air may pass upwardly around the flanged rear side edge 74 of baffle 72 as indicated by the arrow 76 in FIG. 2. Also, central portion 58 is preferably supported off the floor by side flanges 78, with insulation 79 provided therebetween. A flange 82 is attached to central portion 58 and is bolted or otherwise attached to the bottom wall 12 of fireplace 10.

The damper structure and operation are more evident from the showings of FIGS. 3 and 4. Shaft 70 extends slidably through openings in front plate 66, as previously mentioned, and through a support member 86, held in a stationary position within duct 44 by support bracket 88. Rigid metal discs 90 and 92, of larger and smaller diameter respectively, than opening 64, and a resilient disc 94 preferably of insulating material, are all carried upon shaft 70, being retained somewhat loosely between pins 96 thereon. Shaft 70 is biased toward rearward movement, i.e., for engagement of resilient disc 94 with the periphery of opening 38, by spring 98 which is compressed between washer 100 on shaft 70 and support member 86.

The damper may be moved from the fully closed position shown in FIG. 3 to intermediate and fully open positions to allow outside air flow through the structure by pulling handle 68, thereby moving shaft 70 and the discs carried thereby axially, as indicated by arrow 103 in FIG. 3. The damper may be retained in the intermediate position by turning handle 68 and shaft 70 90° in either direction, after sufficient axial movement, so that a pin 102 which extends radially from shaft 70 is engaged by one of surfaces 104 and 106 on support member 86. Shaft 70 may be further moved and retained with the damper structure in the fully open position by rotation to engage pin 102 upon support member surface 108.

From the foregoing, it is apparent that the invention attains the earlier-stated objects by providing a substantially uniform curtain of outside air distributed across the lower, front side of the firebox opening. Thus, outside air is available both to support combustion and to provide cooling air about the fireplace walls by entering the opening 34 provided below the hearth for such purpose. Uniformity of air flow is enhanced by structure of the air supply manifold and baffle arrangement therein.

Figure 6:
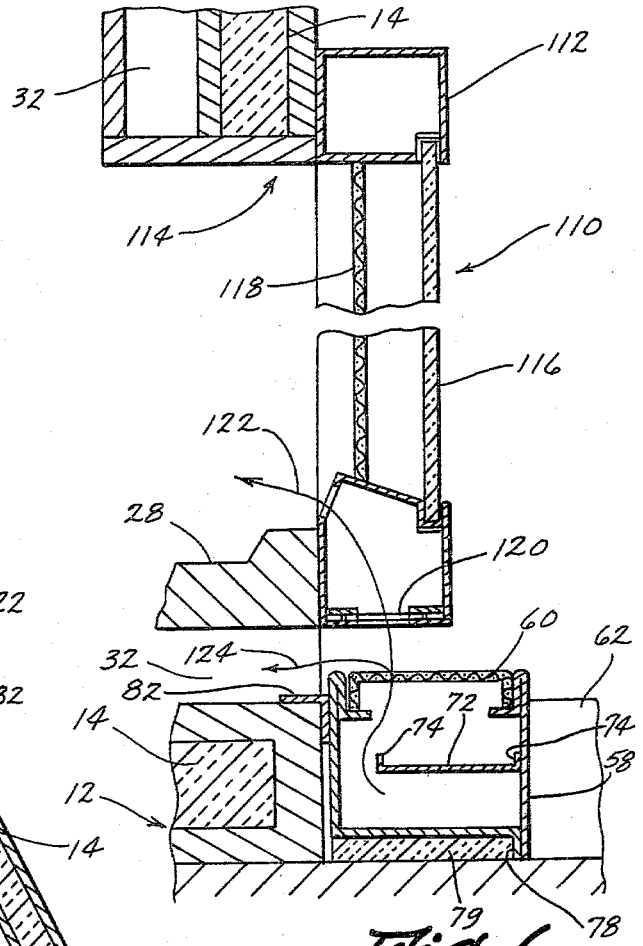
FIG. 6 is a partial sectional view similar to FIG. 5, but showing glass doors mounted over the fireplace opening.

As shown in FIG. 6, the present invention may be utilized to advantage with fireplaces having glass doors, or similar frontal closures, by allowing the outside air to enter through a gap between the lower edge of the doors and the front edge of the hearth, as well as in the illustrated open-front fireplace.

A glass door 110 includes a header 112 mounted across the top of opening 114 of the fire box of the fireplace. Door 110 includes a glass plate 116 and an interior screen 118 for use when the door is open. At the bottom of door 110 is an air shutter 120 which may be manually opened or closed to control the draft entering the fire box. Shutter 120 is in upward spaced relation above grill 60 of the manifold 52. Thus, when shutter 120 is opened, air may enter the fire box from grill 60 upwardly through shutter 120 and into the interior of the fire box as designated by the arrow 122 in FIG. 6. Similarly, some of the air from grill 60 is free to enter opening 34 below hearth 28 as indicated by the arrow 124, thereby providing fresh cool air for cooling the heat emanating from hearth 28, fire wall 36, and rear plate 38.

Thus, it can be seen that the device accomplishes at least all of its stated objectives.

What is claimed is:

1. An improved system for providing a supply of air to a fireplace for supporting combustion in the firebox thereof and for cooling the walls of the fireplace from a source outside the space wherein the fireplace is installed said fireplace comprising a firebox having a hearth floor, a rear wall, opposite side walls, and a front firebox opening, said fireplace having an outer housing surrounding said firebox in spaced relationship so as to form air passageways between said outer housing and each said wall and hearth of said firebox, said passageways including a front passageway opening adjacent the front edge of said hearth, said improved system, comprising:

(a) at least one elongated duct extending from communication at one end with the outside air source to a position laterally adjacent the fireplace;

(b) an air manifold extending horizontally substantially fully across the front of the fireplace, closely adjacent and in front of the lower, front edge of the firebox;

(c) communication means through which the outside air passes from said duct into said manifold; and (d) means defining an elongated opening fully across the front of the fireplace through which the interior of said manifold communicates with the space immediately below and in front of the firebox, whereby outside air from said manifold is drawn into the firebox to support combustion, and to pass cool air beneath the hearth and to the walls of the fireplace to cool said walls, (e) a horizontal baffle means within said manifold for dividing the air into an upper layer directed towards the interior of said firebox through said front firebox opening thereof for supporting combustion, and a lower layer directed toward said front passageway opening for providing cooling air to said passageways to cool said walls of said firebox and to provide air to said firebox for combustion.

2. The invention according to claim 1 wherein said manifold is fully open across at least that part of its upper surface adjacent the lower front edge of the firebox.

3. The invention according to claim 2 and further including horizontally disposed grillwork covering the opening in the upper surface of said manifold.

4. The invention according to claim 1 wherein said communication comprises a hollow, box-like structure communicating through an opening on one side with said duct and on the other with said manifold.

5. The invention according to claim 4 and further including damper means movable between open and closed positions with respect to the opening through which said duct communicates with said box-like structure.

6. The invention according to claim 4 wherein said system includes a pair of ducts, extending along opposite sides of the fireplace and both communicating with said manifold at opposite ends thereof.

7. The invention according to claim 4 wherein said system includes a pair of ducts, extending along opposite sides of the fireplace and both communicating with said manifold at opposite ends thereof, and further including damper means selectively movable to open or close communication between said ducts and said manifold.

8. The invention according to claim 1 wherein said system includes a pair of said ducts extending along the sides of the fireplace, said communication means comprises a pair of box-like structures each communicating on one side with one of said ducts and on the opposite side with said manifold at opposite ends thereof.

9. The invention according to claim 1 and further including space means for elevating said manifold off the floor.

10. The invention according to claim 8 wherein the plane of the top of said manifold is substantially flush with the upper surface of the fireplace hearth extension and said manifold lies between the hearth extension and front, lower edge of the fireplace.

* * * * *